United States Patent [19]

Sten

[11] 4,243,893

[45] Jan. 6, 1981

[54] SUPPLEMENTAL COOLING SYSTEM FOR PORTABLE ELECTRIC POWER PLANTS

[75] Inventor: Nathan Sten, Chula Vista, Calif.

[73] Assignee: Aktiebolaget Electrolux, Stockholm, Sweden

[21] Appl. No.: 957,644

[22] Filed: Nov. 3, 1978

[51] Int. Cl.[3] ..... F01P 1/06

[52] U.S. Cl. ..... 290/1 B

[58] Field of Search ..... 290/1 A, 1 B; 60/39.66, 60/DIG. 5

[56] References Cited

U.S. PATENT DOCUMENTS

| | | | |
|---|---|---|---|
| 1,989,139 | 1/1935 | Koch, Jr. | 290/1 B |
| 2,240,664 | 5/1941 | Moore | 290/1 B |
| 4,079,262 | 3/1978 | Merkle | 290/1 B |
| 4,122,353 | 10/1978 | Noguchi | 290/1 A |

FOREIGN PATENT DOCUMENTS 580023 7/1959

*Primary Examiner*—J. V. Truhe
*Assistant Examiner*—W. E. Duncanson, Jr.
*Attorney, Agent, or Firm*—Brown & Martin

[57] ABSTRACT

The system utilizes excess primary coolant air normally utilized to cool the primary components (generator and engine) and diverts the cooling air to enclosures requiring supplemental cooling. Air from the engine blower is diverted through a double hulled enclosure around the exhaust system to reduce noise, fire hazard and burn hazard. Air from the generator cooling fan is diverted through a duct to an electronics enclosure. The air thus diverted provides direct supplemental cooling to increase the performance and reliability of the electronics mounted on the power plant and to reduce the exterior temperature of the enclosure for the purposes noted for the exhaust system enclosure.

12 Claims, 7 Drawing Figures

SUPPLEMENTAL COOLING SYSTEM FOR PORTABLE ELECTRIC POWER PLANTS

BACKGROUND OF THE INVENTION

For many years mobile (portable) electric power plants have been utilized, for example, in association with motor vehicles to locally generate electric power and particularly to provide a portable source of 120 volt alternating current. Such power plants typically must be accommodated in a relatively small compartment provided for this purpose. The size of the compartment is dictated both by space and noise considerations. At the same time, a countervailing consideration is the fire hazard and burn hazard associated with the operation of these units.

The internal combustion engine, typically a gasoline, single cylinder four stroke engine, produces exhaust gas temperatures in excess of 665° C. Such temperatures are sufficient to ignite certain combustible materials and are sufficiently high to injure any person coming in direct contact with the exhaust manifolds, through which such gases pass. Merely enclosing the exhaust manifold to prevent direct contact by an operator or by combustible materials with the exhaust manifold does not substantially reduce the problem. The relatively limited circulation of air within such a single hull enclosure transmits most of the heat to the enclosure so that the enclosure itself attains unacceptably high temperatures.

The high heats produced in the power plant compartment also produce a severe environment for the on-board electronics. Relatively high power dissipation electronics must be provided to regulate the power produced and to govern the charging of any associated starting batteries. The performance, service life and reliability of the associated on-board electronic components such as high power rectifiers, are adversely affected by the resulting temperatures.

Accordingly, it is desirable to have a cooling system for mobile electric power plant enclosures. To reduce the temperatures associated with both the exhaust system enclosure and the electronic enclosures, and thereby reduce the risk of fire hazard and burn hazard. Such a system is particularly desirable where it does not substantially increase the cost of the enclosure and further muffles the sound from the operating power plant.

SUMMARY OF THE INVENTION

In an exemplary embodiment of the invention, cooling air for the enclosures is diverted from the engine and generator (primary components) cooling blower and fan respectively. Such a diversion of the cooling air does not necessarily increase the total amount of heat rejected from the system to the outside environment, but, as will appear more particularly hereinafter, provides a multi-stage reduction in the temperatures experienced at critical parts of the enclosure. By diverting existing cooling air, no additional moving parts are required and therefore the reliability of the unit and its cost are not substantially affected.

An enclosure for the exhaust system is provided. The enclosure surrounds substantially the entire exhaust system and in a typical case, may partially enclose both sides and extend across the top and ends of the engine. Those portions of the enclosure which are in direct proximity to the exhaust manifold and/or muffler and pipe are provided with a double hulled construction. That is, two enclosing walls are spaced from one another by a substantial distance. Air diverted from the engine blower is forced into the space between the two walls of the double hulled construction and flows through substantially the entire double hulled portion of the enclosure to be exhausted at a point remote from the point of entry. Thus, relatively low temperature engine cooling air passes over the relatively hot interior wall of the enclosure and carries away the heat to be exhausted from the enclosure. A multi-step temperature reduction is obtained as follows:

1. The exterior of the exhaust manifold is at a temperature lower than the interior according to the generally accepted laws of heat flow.

2. The air surrounding the exhaust manifold is a relatively poor conductor of heat and therefore the temperature of the inner wall of the double hulled construction is lower than the air immediately adjacent the exhaust manifold.

3. The air passing between the two walls of the double hulled portion of the enclosure is not only a relatively poor conductor of heat, but much of the heat transferred from the inner wall of the enclosure is exhausted from the enclosure from the air flow.

4. Finally, the outer wall of the enclosure is cooled both from within and by the process of radiation and convection from without so that it is at a lower temperature than the air passing between the hulls.

The second major enclosure of the invention is an electronics enclosure mounted on the power plant and housing the electronics control systems as set forth in the Background of the Disclosure. Air is diverted from the cooling fan of the generator through a tubing duct to the enclosure. The tubing duct is mounted so that its entry mouth is in substantial alignment with the air flow through the cooling fan. Accordingly, a portion of the air flow is diverted through the duct and into the electronics enclosure. Within the enclosure the air is directed over the critical electronics components and exhausted through holes provided in the enclosure for that purpose. Accordingly, not only is the enclosre cooled by being mounted away from the exhaust manifold and other high heat sources, but a direct cooling effect is obtained by diverting cooling air from the generator. This not only reduces the operating temperature of the electronics, but reduces the external temperature of the enclosure to the point where the burn hazard is reduced or eliminated.

It is therefore an object of the invention to provide a new and improved cooling system for power plant enclosures. In reaching the objects of the invention, applicant has provided a system that is relatively simple in construction and easily accommodated on the power plant, while at the same time providing cooling for both the exhaust system and the electronics system. The system has no moving parts, and therefore does not substantially increase the overall complexity of the power plant.

DETAILED DESCRIPTION OF THE DRAWINGS

Figure 1:
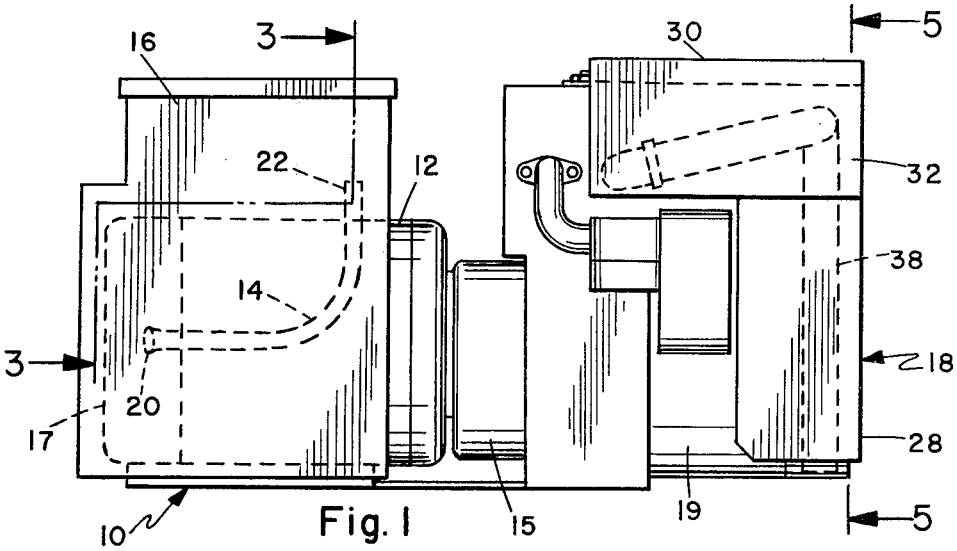
FIG. 1 is a side elevation view of the power plant units showing the enclosure cooling system in place.
Figure 2:
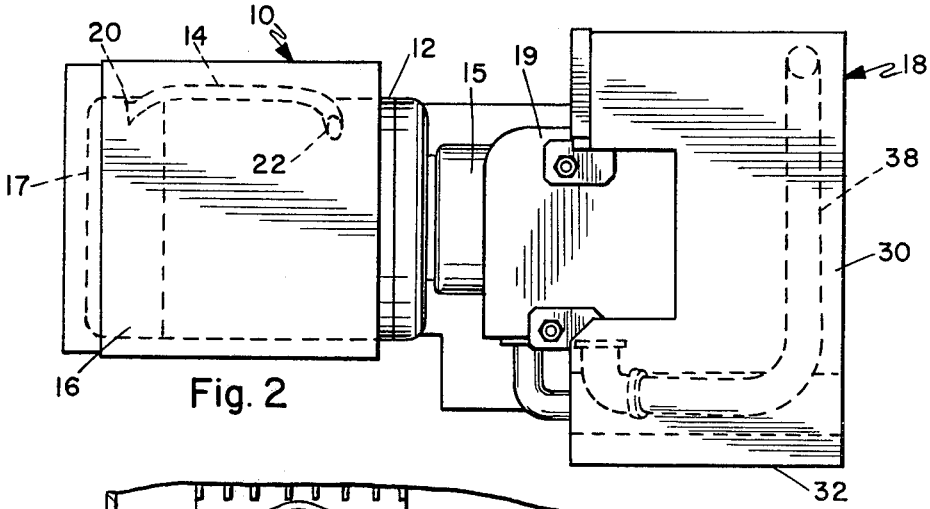
FIG. 2 is a top plan view of the power plant.

Referring now to the drawings, FIG. 1 illustrates the entire power plant 10 as comprising the generator unit 12, the gasoline power plant 19, and a transmission 15 connecting the power plant 19 to the generator 12. The general arrangement of the cooling system is also illustrated. The diverter for the electronics enclosure incorporates a duct in the form of tubing 14 which extends between the cooling fan housing 17 of the generator 12 and the electronics enclosure 16.

Figure 3:
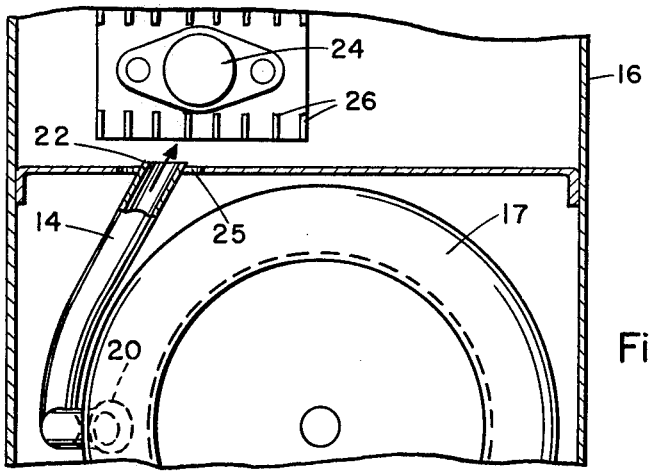
FIG. 3 is an enlarged sectional view taken on line 3—3 of FIG. 1.

The electronics portion of the enclosure cooling system is further illustrated in FIG. 3. The tubing 14 is bent to conform to the outer configuration of the generator housing 12. The tubing 14 enters the cooling enclosure 17 through an elongated slot (not shown) and terminates in an enlarged bell-shaped flared end 20. The generator cooling fan, in the illustrated embodiment, is coaxial with the generator axis producing an air movement that is generally coaxial. Accordingly, the flared entry 20 of the tubing 14 is generally aligned with the coaxial direction so that maximum air diversion with minimum interference is obtained. The diverted air passes through the tubing 14 and exits from the nozzle terminus 22. A relatively high velocity jet of cooling air is thereby produced and directed onto the critical electronic components in the electronics enclosure 16. As illustrated, the air is directed over the cooling fins 26 of a power diode 24. After scavenging heat from the electronics components, the cooling air exhausts through the opening 25 surrounding the nozzle 22 and through other openings in the electronics enclosure (not shown).

Referring again to FIG. 1, the general arrangement of the cooling enclosure for the exhaust system is illustrated. The enclosure 18 is arranged around the principal parts of the exhaust manifold, exhaust pipe, and associated muffler, if any. Enclosure 18 is comprised of three principal sections. A single hulled section 28 which surrounds the engine to create a plenum and to prevent access to the hot parts of the engine 19. The critically hot parts of the engine and particularly the exhaust pipe 38, are surrounded by the double-hulled sections 30 and 32. As will appear more fully hereinafter, air is forced into the double hulled section through the openings 34 and exits the double hulled sections through the openings 36.

Figure 5:
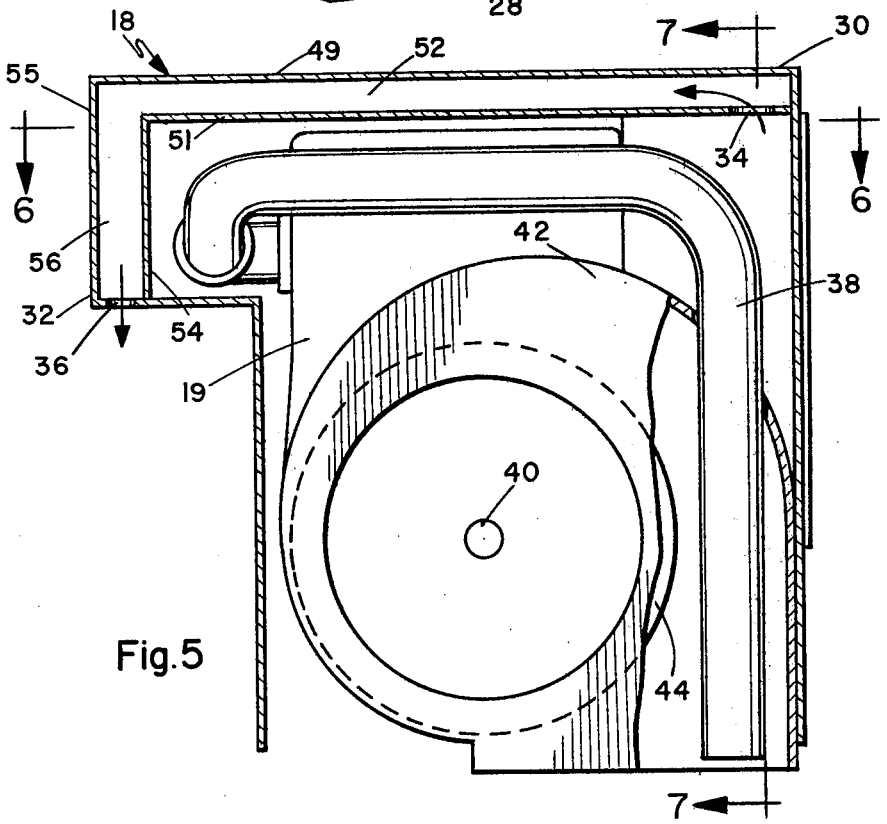
FIG. 5 is an enlarged sectional view taken on line 5—5 of FIG. 1.

FIG. 5 illustrates the housing in place over the engine 19. The exhaust pipe 38 exits the exhaust manifold and passes rearwardly around the engine where it turns downwardly to exit through the cooling shroud 42. The cooling shroud encloses the centrifugal blower 44 which is driven by the crank shaft 40. Thus, the terminal portion of the exhaust system is cooled directly, however the remainder of the exhaust system would be exposed, both from a fire hazard and from a burn injury standpoint, were it not for the exhaust system enclosure of the invention.

Figure 4:
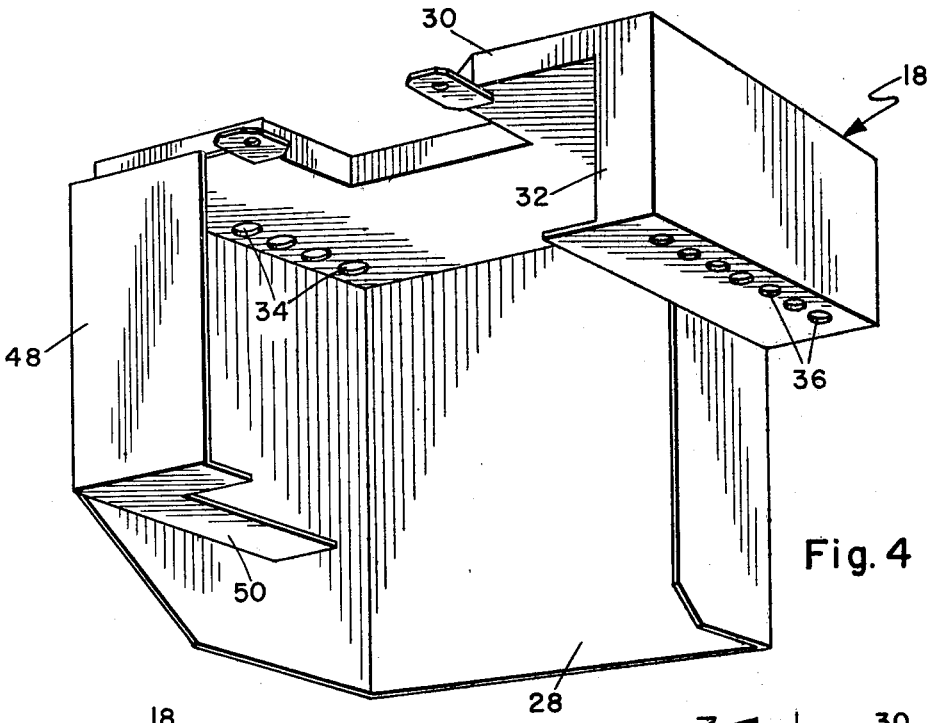
FIG. 4 is a perspective view from below of the exhaust system enclosure.
Figure 6:
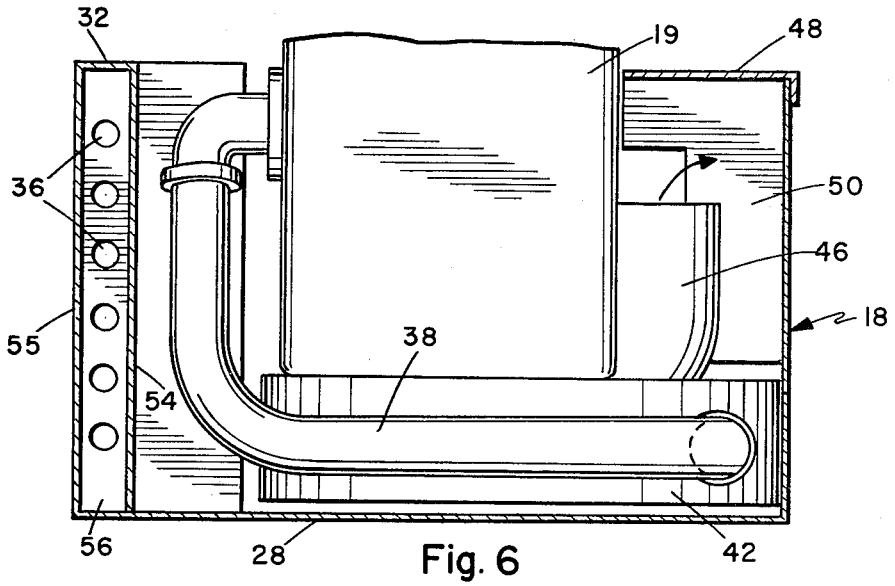
FIG. 6 is a sectional view taken on line 6—6 of FIG. 5.
Figure 7:
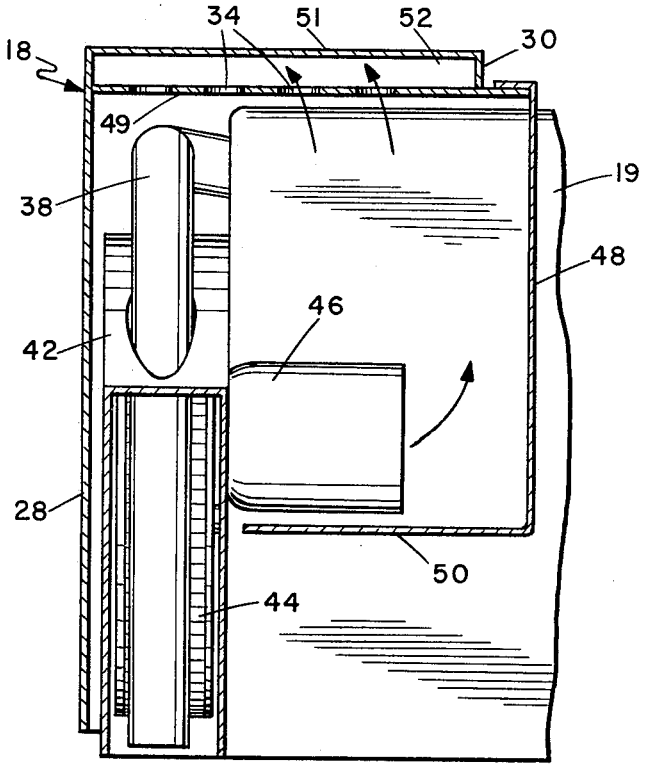
FIG. 7 is a sectional view taken on line 7—7 of FIG. 5.

FIGS. 6 and 7 illustrate the manner in which excess cooling air from the centrifugal blower 44 is ducted into the double hulled construction of the enclosure 18. A blower outlet nozzle 46 is arranged over an opening in the blower housing 42 so that a portion of the high pressure air within the blower housing 42 exits the nozzle 46 and is substantially completely enclosed between the side wall of the engine 19 and the walls 48 and 50 (see FIG. 4) of the enclosure. Thus, the high pressure air cannot escape the enclosure and is forced through the openings 34 into the double hulled construction. As will be apparent from FIG. 7, the portion 30 of the double hulled construction comprises an inner wall 49 and an outer wall 51. The space 52 between the inner and outer walls constitutes a duct for the cooling air. The air passes horizontally through the double hulled section 30 and then into the vertical hulled section 32.

FIG. 6 illustrates the construction of the vertical hulled section, which incorporates an inner wall 54 spaced from an outer wall 55. The space between the inner and outer walls forms a duct 56, whereby the cooling air passes vertically downwardly and exits the holes 36. A horizontal wall 46 at the lower terminus of the double hulled section 32 completes the enclosure to prevent access to the exhaust pipe and thereby to prevent injury to persons utilizing the equipment for the combustion of combustion materials which would otherwise come into contact with the exhaust pipe 38.

It will be noted that in both the electronics enclosure cooling system and the exhaust system cooling enclosure, a double hulled effect is present. Accordingly, the hottest parts of the engine 19 are protected from direct contact with persons or combustible materials and the electronics enclosure itself forms a double hulled construction to prevent direct contact with the most accessible portion (the top) of the generator 12.

Having described my invention, I now claim:

1. A cooling system for power plant enclosures incorporating means for generating cooling air flow for cooling the primary components of the power plant, including an engine cooling blower in a blower housing, the invention comprising:

a diverter means for diverting a portion of the cooling air flow away from the primary components, said diverter means comprising an opening in the blower housing, duct means for ducting the diverted air flow to an enclosure mounted on said power plant, and into heat transfer relationship with heated elements associated with said enclosure, discharge means for exhausting said diverted air flow from said enclosure.

2. The cooling system according to claim 1, wherein said power plant incorporates an engine exhaust system and wherein:

said enclosure having a double hulled construction surrounding at least a part of said power plant and overlying at least a part of the engine exhaust system thereof, said duct means comprising the air passage formed in the space between the walls of said double hulled enclosure.

3. The cooling system according to claim 2, wherein:

said double hulled enclosure surrounds substantially the entire engine exhaust system.

4. A cooling system according to claim 1, wherein said power plant incorporates a generator cooling fan primarily for cooling the electric generator of said power plant and wherein:

said diverter means comprises a duct from said generator cooling fan to an electronic enclosure mounted on said power plant.

5. The cooling system according to claim 4, wherein the generator cooling fan comprises a coaxial fan in a coaxial housing and wherein:

said duct comprises tubing penetrating the generator fan housing and having a terminal end positioned in general alignment with the air flow generated by said cooling fan.

6. The cooling system according to claim 5, wherein:

said tubing terminates in said fan housing with a bell-shaped flared termination.

7. The cooling system according to claim 4, wherein the power plant further incorporates an engine cooling blower in a blower housing and wherein:

said diverter means additionally comprises an opening in said housing.

8. The cooling system according to claim 7, wherein said power plant incorporates an engine exhaust system and wherein:

said enclosure having a double hulled construction surrounding at least a part of said power plant and overlying at least a part of the engine exhaust system thereof, said duct means comprising the air passage formed in the space between the walls of said double hulled enclosure.

9. The cooling system according to claim 8, wherein:

said double hulled enclosure surrounds substantially the entire engine exhaust system.

10. In a power plant including an internal combustion engine, an exhaust system for the engine and means for generating cooling air flow mounted to provide a flow of cool air for cooling said power plant, the improvement comprising:

a single walled enclosure surrounding at least a portion of said engine, a double walled section of said enclosure surrounding at least a portion of the exhaust system, means directing air from said means for generating cooling air flow into said first enclosure, means directing air from said first enclosure to flow between the walls of said double walled section, and means exhausting air from between the walls of said double walled section.

11. The power plant of claim 10 wherein:

said double walled section is spaced from said exhaust system and extends horizontally across the top of the engine.

12. The power plant of claim 10 further comprising:

a generator having a cooling fan therein, an electronic circuit, an enclosure means surrounding said electronic circuit, and duct means coupled between said enclosure means and said generator for directing air from the cooling fan of said generator into said enclosure means.

* * * * *